United States Patent [19]

Rabban

[11] 4,404,704

[45] Sep. 20, 1983

[54] CLEANING KIT

[76] Inventor: Philipp Rabban, P.O. Box 401, Hollywood, Fla. 33022

[21] Appl. No.: 325,694

[22] Filed: Nov. 30, 1981

[51] Int. Cl.[3] ..... A47L 13/51

[52] U.S. Cl. ..... 15/257 R; 15/1; 280/47.19

[58] Field of Search ..... 15/257 R, 260–264, 15/4, 1; 280/24, 47.19, 79.2

[56] References Cited

U.S. PATENT DOCUMENTS

| | | | |
|---|---|---|---|
| 2,723,864 | 11/1955 | Schierman | 280/47.19 X |
| 2,780,822 | 2/1957 | Dickinson | 15/257 R X |
| 3,409,932 | 11/1968 | George | 15/260 |
| 3,934,894 | 1/1976 | Hoeffken | 280/47.19 |

*Primary Examiner*—Edward L. Roberts
*Attorney, Agent, or Firm*—Joseph Zallen

[57] ABSTRACT

A cleaning kit adapted to clean a large area comprises a preliminary cleaning device, a finishing cleaning device, and a cleaning cart including a base frame, a handle having a retaining member and at least two containers situated on the base frame. The preliminary and finishing cleaning devices include a plurality of preliminary and finishing cleaning appliances respectively, the appliances being adapted to be removably connected to each end of the cleaning device. The base frame of the cleaning cart includes at least two wheels connected at one side of the bottom of the base frame and a plurality of floor engaging projections situated at the other side of the bottom of the base frame. The preliminary and finishing cleaning devices are retained in the retaining member of the handle, while the preliminary and finishing cleaning appliances are separately disposed in the two containers.

3 Claims, 5 Drawing Figures

CLEANING KIT

BACKGROUND OF THE INVENTION

The invention relates to a cleaning kit designed to easily clean a large area, especially to clean the floors of hospitals, schools or other institutional buildings or commerical or industrial buildings.

Most institutional, commercial or industrial buildings are generally provided with plastic, concrete or wooden floor surfaces, which are cleaned with mops, brooms or other means. When mops are used for cleaning the floor, the mops have to be washed with water once the mops get dirty. Therefore, there is required a bucket containing water and having means to squeeze the mops after washing. The bucket has to be carried whenever and wherever the mop is used for cleaning the floor, and when the mop gets dirty, the mop must be washed by means of the water in the bucket. Cleaning the floor by itself is hard work, but in addition to that, carrying the bucket with water and washing the mop so many times is also very hard. Consequently, cleaning the floor by means of a mop is really heavy work. Moreover, the water in the bucket becomes dirty even upon the first rinsing of the mop therein and, consequently, in short order, the floor is being mopped with dirty water.

Accordingly, an object of the present invention is to provide a cleaning kit with which mopping of a floor can be rapidly and easily done without carrying heavy supplies.

Another object of the invention is to provide a cleaning kit as stated above, by means of which labor for cleaning floors can be substantially reduced with a consequent reduction of cost.

Yet another object of the invention is to provide a cleaning kit as stated above which cleans floors more thoroughly by avoiding repeated use of dirty water.

A further object of the invention is to provide a cleaning kit as stated above, which is simple and can be easily manufactured.

A still further object of the invention is to provide a cleaning cart to be used for a cleaning kit as stated above.

Other objects and advantages of the invention will be apparent from the following description of the invention.

SUMMARY OF THE INVENTION

In accordance with the present invention, a cleaning kit adapted to clean a large area is provided. The cleaning kit comprises preliminary cleaning means, finishing cleaning means and a cleaning cart. The preliminary cleaning means includes a plurality of liquid absorbent cleaning appliances substantially saturated with a preliminary cleaning liquid, and the finishing cleaning means includes a plurality of liquid absorbent cleaning appliances substantially saturated with a finishing cleaning liquid. The preliminary and finishing cleaning means also include at least one handle means to an end of which a respective cleaning appliance is adapted to be removably attached. The cleaning cart is provided with a base frame having at least two wheels at one side thereof and a plurality of floor engaging projections, a handle connected to the base frame at the wheel side thereof and at least two containers situated on the base frame. The wheels are attached to one side of the bottom of the base frame and the floor engaging projections are attached to the opposite side of the frame. The cart handle includes a retaining member for retaining the cleaning appliances handle means therein. One of the containers receives the preliminary cleaning means, and the other container receives the finishing cleaning means. The preliminary cleaning means is at first used for primary cleaning, and thereafter the finishing cleaning means is used. When the preliminary and finishing cleaning means get dirty, the appliances are replaced with new ones. The used appliances are separately kept in the respective containers from the clean appliances.

The cleaning kit of the invention is further provided with two flexible, preferably plastic, bags situated in the respective containers to keep the used cleaning appliances therein. Consequently, the dirty appliances are conveniently and reliably separated from the clean appliances. Preferably, the preliminary cleaning liquid is a conventional aqueous detergent solution and the finishing cleaning liquid is water.

While the invention is especially suitable for use in institutional, commercial or industrial buildings, it may, of course, be used in houses, too.

PREFERRED EMBODIMENT OF THE INVENTION

Figure 1:
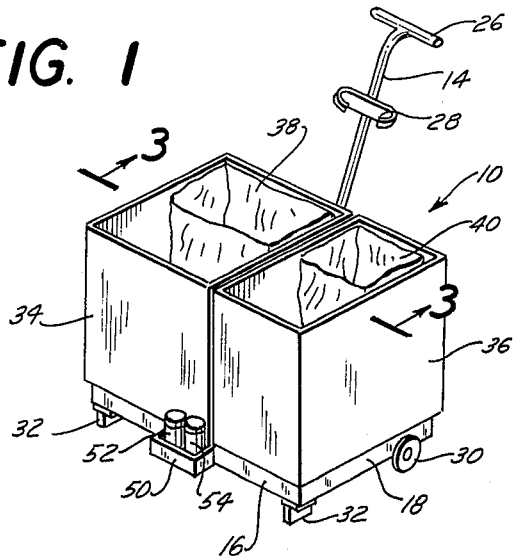
FIG. 1 is a perspective view of a cleaning cart in accordance with the present invention.
Figure 2:
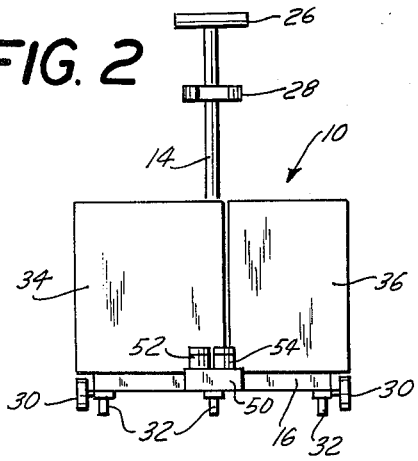
FIG. 2 is a front view of the cleaning cart.
Figure 4:
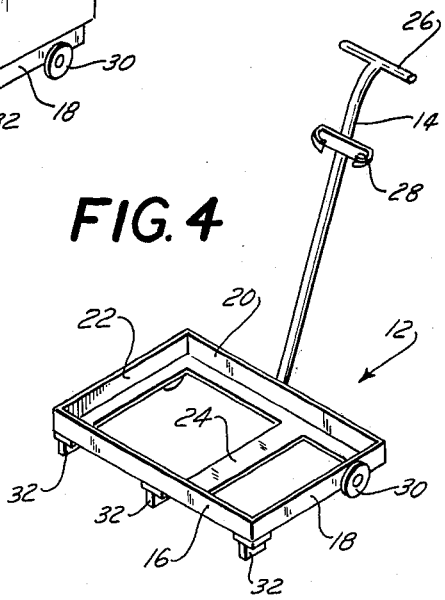
FIG. 4 is a perspective view of a frame with a handle of the cart.
Figure 3:
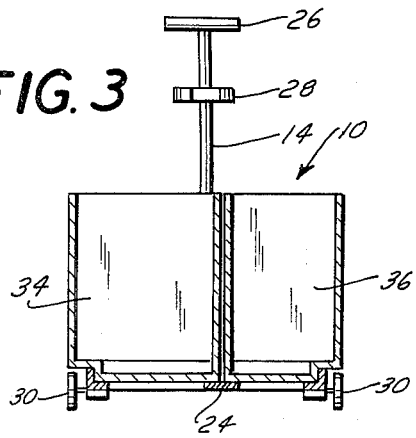
FIG. 3 is a section view taken along lines 3—3 in FIG. 1.

Referring to FIGS. 1–3, a cleaning cart 10 in accordance with the present invention is shown. The cleaning cart 10 is provided with a base frame 12 and a handle 14 as clearly shown in FIG. 4. The base frame 12 is formed of four side portions 16, 18, 20, 22 of L-shape cross section and a flat bottom portion 24. The handle 14 includes a grip 26 at an upper end and a retaining plate 28, and is welded to a center of the side portion 20 at a lower end thereof. A pair of wheels 30 are rotatably connected to the respective side portions 18, 22, and three projections 32 are attached to the side portion 16 to extend downwardly therefrom. Therefore, when the handle 14 is pushed down to lift up the projection 32 from the floor, the cart 10 can be transported by means of the wheels 30. When the projections 32 are situated on the floor, the cart 10 cannot be moved.

The containers 34, 36 are located on the base frame 12. Each container includes three lower margins recessed inwardly from three respective outer walls to form respective step portions and a fourth lower margin flush with the respective fourth outer wall. The walls having flush lower margins of the respective containers 34, 36 face each other and the containers are situated in the frame 12, so that the walls with the depressed lower margins are located outside the side portions of the frame 12 and the bottoms of the containers 34, 36 are located within the side portions of the frame 12. A flat bottom portion 24 of the frame 12 is located beneath the junction of the containers 34, 36 to support the same.

Figure 5:
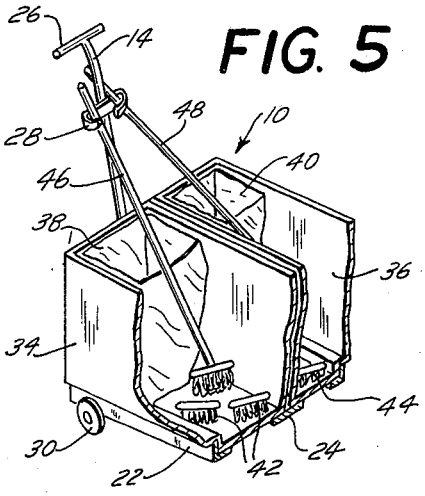
FIG. 5 is an explanatory view of a cleaning kit.

The containers 34, 36 are provided with plastic bags 38, 40 and a plurality of mops 42, 44, as shown in FIG. 5. The mops 42 are soaked with a detergent for preliminary cleaning and the mops 44 are soaked with water for rinsing after the preliminary cleaning. A mop stick 46 can be detachably connected to one of the mops 42, and a mop stick 48 can be also detachably connected to one of the mops 44. The means for connecting the mops 42, 44 to the sticks 46, 48, such as screw threads, are known in the art, so that such means are not described in detail in the present application.

When the cleaning cart 10 of the invention is used, the cart 10 is carried to a place to be cleaned. At first, the mop 42 is used for preliminary cleaning of the floor, and then the mop 44 is used for finishing. When the mops 42, 44 get dirty, the mops are respectively replaced with new ones and the dirty mops are stored in the respective bags 38, 40. In case some specific area is cleaned by the mops 42, 44, the mops 42 are generally used much more than the mops 44, so that the container 34 is designed bigger than the container 36 to have enough mops 42 therein. When the mops are not used, the sticks 46, 48 are placed in the retaining plate 28. The used mops in the bags 38, 40 are washed later by a washing machine. Thereafter, the mops are soaked with the detergent and water, so that the mops can be used many times.

Attached to the side portion 16 of the base frame 12 is a box 50 in which two bottles 52, 54 are disposed. The bottle 52 includes the detergent and the bottle 54 includes water so that the detergent and water can be used in case of necessity.

In accordance with the cleaning kit of the invention, the cleaning cart is provided with a plurality of preliminary cleaning mops 42 and finishing mops 44 in the containers, and when the mops 42, 44 get dirty, the mops are respectively replaced with new ones and dirty mops are stored in the bags. The used mops are finally washed by the washing machine and are used again. Therefore, it is unnecessary to carry water in the cart for washing the mops. Cleaning can be easily made without excessive labor in accordance with the cleaning kit.

While the invention has been described with reference to a specific embodiment, it is to be noted that the description is illustrative and the invention is limited only by the appended claims.

What I claim is:

1. A cleaning cart comprising:

a base frame having side portions and at least two wheels connected at one side of the bottom of the base frame and a plurality of floor engaging projections situated at the other side of the bottom of the base frame;

a handle connected to the base frame at the wheel side, said handle having a retaining member adapted to receive and retain at least two handles for preliminary and finishing cleaning devices; and at least two containers situated on the base frame, each said container including three lower margins recessed inwardly from three respective outer walls to form respective step portions and a fourth lower margin flush with the respective fourth outer wall, said walls having flush lower margins of two respective containers facing each other, the walls with the depressed lower margins being located outside the side portions of the frame, the bottoms of the containers being located within the side portions of the frame, one container receiving therein a plurality of preliminary cleaning appliances to be removably attached to said preliminary cleaning device and another container receiving therein a plurality of finishing cleaning appliances to be removably attached to said finishing cleaning device.

2. The cleaning cart according to claim 1, in which said containers respectively include flexible bags therein to receive the used cleaning appliances for separating the same from the clean appliances when the cleaning appliances are changed.

3. The cleaning cart according to claim 1, in which three floor engaging projections are provided on the bottom of the base frame, so that when the cart is located on a floor, the cart can be immovably held by the projections.

* * * * *